United States Patent [19]

Graf et al.

[11] 4,110,075

[45] Aug. 29, 1978

[54] PROCESS FOR WASHING TEXTILES IN AN AUTOMATIC WASHING MACHINE, WORKING SUBSTANCES AND APPARATUS FOR ITS PERFORMANCE

[75] Inventors: Richard Graf; Lieselotte Brodzina, both of Berlin; Rudolf Ströbele; Helmut Stache, both of Marl, all of Fed. Rep. of Germany

[73] Assignees: Bosch-Siemens Hausgeräte GmbH, Munich; Chemische Werke Huls A.G., Marl, both of Fed. Rep. of Germany

[21] Appl. No.: 747,420

[22] Filed: Dec. 6, 1976

[30] Foreign Application Priority Data

Dec. 4, 1975 [DE] Fed. Rep. of Germany ..... 2554592

[51] Int. Cl.[2] ..... B08B 3/00

[52] U.S. Cl. ..... 8/137; 8/151; 8/155; 68/17 R

[58] Field of Search ..... 8/137, 151, 155; 68/17 R

[56] References Cited

U.S. PATENT DOCUMENTS

| | | | |
|---|---|---|---|
| 2,489,278 | 11/1949 | Fink | 8/137 |
| 3,071,432 | 1/1963 | Geschka et al. | 8/137 |
| 3,197,271 | 7/1965 | Smith et al. | 8/137 |
| 3,510,026 | 5/1970 | Wright | 68/17 R X |
| 3,954,630 | 5/1976 | Ramachandran | 8/137 |
| 3,982,666 | 9/1976 | Kleimola et al. | 68/17 R |
| 3,994,682 | 11/1976 | Braun et al. | 8/137 |
| 4,009,598 | 3/1977 | Bernard | 68/17 R |

*Primary Examiner*—William E. Schulz
*Attorney, Agent, or Firm*—Herbert L. Lerner

[57] ABSTRACT

Washing process for textiles in an automatic washing machine, with application of active washing substances, structural substances and bleaching agents, involving loading of the textiles in the washing machine, adding water, agitating the textiles in the washing solution, pumping off the washing solution, and sequential rinse cycles, wherein the following active substances or combination of active substances are maintained in pumpable form in separate containers and added to the mixture in pumpable form before or during the washing process:

1. Active washing substances,
2. Structural substances,
3. A stabilized bleaching agent, if required,
4. A catalyst which accelerates the bleaching process, if required, and
5. A soft rinse agent, if required. After loading of the textiles to be laundered, the water is added in the ratio of 1:4 to 1:30 of kg. dry textile to liters water, 0.5 to 3.5g of active washing substances per liter washing mixture are added, 2 to 6.5g structural substances per liter washing mixture are added, washing carried out at a predetermined temperature with agitation for a period up to 50 minutes, the washing solution drained off and the washed textile subjected to 2 – 5 rinse cycles.

22 Claims, 9 Drawing Figures

PROCESS FOR WASHING TEXTILES IN AN AUTOMATIC WASHING MACHINE, WORKING SUBSTANCES AND APPARATUS FOR ITS PERFORMANCE

BACKGROUND OF THE INVENTION

1. Field of the Invention

This invention relates to washing textiles and more particularly refers to a new and improved process, and apparatus therefor, for washing laundry in an automatic washing machine.

2. Description of the Prior Art

Up to now washing process for textiles in automatic washing machines consumed considerable amounts of water, energy and washing agents, and their wastes contributed to a great extent to the pollution of the environment.

In the known washing processes for heavy and white laundry, before each wash process, commercial washing agents are introduced into compartments which are provided for this purpose in the machine. According to conventional instructions by washing machine manufacturers, approximately 140g of a washing agent are provided for each soak and wash period (i.e. in washing machines for 4 kg dry wash with approximately 20 l (liters) of liquid mixture (7g/l in the soak period and approximately 7 g/l in the wash period). During the wash period, the liquid mixture is heated to approximately 50° C and in some cases the washing drum is moved back and forth at this temperature. Thereafter, the wash solution is siphoned off and fresh water is added and again approximately 140g washing agent is introduced from the storage chamber and the main washing operation is carried through, whereby the liquid mixture is usually heated to between 90° and 95° C, under a reversing motion and the drum is kept in motion at this temperature for another 10 to 15 minutes. Thereafter, the machine is filled with fresh water for a higher mixture ratio and the laundry is rinsed in up to seven rinse cycles from 2 to 5 minutes each, with a water change for each cycle, in order to remove remaining washing agents and to disperse the dirt. For achieving a soft laundry, water softeners may additionally be added to the last rinse.

The known methods for washing are usually performed in automatic washing machines in which a drum is rotatable and horizontally positioned in a tank, whereby the drum serves as container and agitator for the laundry. As a rule, an electric motor is used for driving the drum.

Such washing machines are provided usually with so-called wash agent containers consisting of two compartments which are filled by the user with the required amount of washing agents before beginning the washing process. In machines with wash-agent containers with several compartments, a provision is usually also made for a commercial water softener. The compartments of the washing agent container, are connected with the fresh water supply of the machine by electrically controlled valves and on the other side, with an input channel to the tank.

Furthermore, the known automatic washing machines contain a program selector switch for the setting of the desired program depending on the type of laundry to be washed and its degree of dirtiness, and also a program control device in which, by mechanical and/or electrical means, the corresponding wash programs are stored so that, by its operation, the various functions, namely water admission, heating, laundry agitation and draining, are controlled in the desired sequence. The mentioned functions are additionally influenced by temperature and water level measuring devices.

For the removal of the liquid which is no longer needed in the tank, a drain opening is generally provided at the lowest point, which communicates over a drain pump and a riser tube into a discharge tube and drain.

The performance of the known wash processes for textiles in automatic washing machines is usually done with commercially packaged washing agents. These washing agents in powder form contain mainly the following active substances: active wash components, principally surface-active agents, complex alkali phosphates as main structural components, alkali-perborates as bleaches and also silicates as alkali carriers and bleach agent stabilizers.

Though the packaged commercial washing agents which are used at the beginning of the washing process have a very good washing effect, their use causes some of the disadvantages of the up-to-now known wash processes which are carried out in washing machines.

Usually, the content of complex phosphates in packaged commercial washing agents is set so high that it is sufficient for very hard water (ca 20 ° dH).

However, according to statistics only approximately 60% of the households in the German Bundesrepublik wash with water over 15° dH (SÖFW 20/1961, pages 621 to 637. H. Oxe) which means that about 40% of the German households are residing in areas with typical soft water. Consequently, in these households the washing is either done with an overdose of phosphates and an unnecessary waste of material or, if one stays within the recommended dosage for low water-hardness areas, the washing process is carried out with an underdose of detergents and unclean laundry will result.

Add to this the fact that, though the washing agent manufacturers print on their packages recommendations for the dosage according to general experience, there is a tendency to overdose the washing agent when adding it by hand, which results in detrimental effects to the environment.

Furthermore, the statistics reveal (SÖFW 19/1974, page 491 in conjunction with the Handbook for textile engineers and textile technicians "Grundlagen der Textilveredlung" part I 61, page 21) that washing agents for fine laundry are used in a considerably lesser amount compared to the amount of actually existing fine laundry. Thus the overwhelming part of fine laundry is washed, in practice, with washing agents for heavy laundry.

However, in the known washing methods with a washing temperature of up to 60° C the bleaching agents (perborates) and their stabilizers, which make up approximately 30% of a general purpose washing agent or full washing agent, are not utilized since they can only become active at temperatures far above 60° C. Thus, also in the case of fine laundry, generally an excessive amount of chemically active substances is used and the environment is polluted as a result thereof.

Furthermore, it is known that due to the general habits with respect to handling laundry in most households, a full washing agent is also used in the soaking process. However, in the soaking process too, the high portion of bleaching agents, which is up to 30% in a full-washing agent, is not effective because of the lower temperatures and therefore leaves the washing process in an unutilized state. Thus, in this case too, an excessive amount of active substances is used and the environment is additionally polluted.

Even when washing in temperatures up to boiling, a considerable portion of the perborates goes unused into the drain water. One of the reasons for this is that the manufacturers of general purpose washing agents must set the proportion of bleaching agents for the highest possible spot cleaning efficiency. However, as can be learned from the literature (Trace Elements in the Environment, Advances in Chemistry, Series 123, Page 135) a relatively high boron content in natural waters can have a detrimental effect on the growth of some plants. It must also be considered that the maker of pulverized general purpose washing agents, generally uses alkali-perborates since the other known bleaching agents are less suited for this purpose.

The usage of perborates entails other disadvantages in addition to the above-mentioned ones. First, it is necessary to heat the washing mixture far above 60° C for bleaching purposes, since the dissociation of perborates begins with slow speed only above 60° C and only at approximately 90° to 95° C does dissociation rapidly take place so that an effective bleaching process is carried out. This makes it necessary to carry out the washing process for white laundry at 95° C, since washed, but an unbleached white laundry is not considered as clean.

However, a maximum temperature of 60° C of the washing mixture would be sufficient for the removal of the dirt and its dispersion to so fine a distribution that a re-depositing onto the washed fabric does not occur.

The use of complete all purpose washing agents for washing with bleaching, thus requires a high washing temperature. Therefore, a high energy consumption relative to the wash effect is required.

Finally, the high water consumption of the up to now practiced washing processes must be considered.

The manufacturer of washing machines has to make sure to provide in the automatic sequence of the conventional wash process a sufficient number of rinse cycles so that the remaining alkali content cannot result in damage to the fabric or be a skin irritant. This is particularly important because overdosing of the washing agent by adding it by hand frequently occurs.

SUMMARY OF THE INVENTION

An object of the present invention is to provide an efficient washing process for textiles in automatic washing machines, and apparatus therefor, to reduce consumption of washing agents, water, and energy and thereby reduce wastes of washing agents which contribute to the pollution of the environment.

With the foregoing and other objects in view, there is provided in accordance with the invention a washing process for textiles in an automatic washing machine with loading of the textiles in the machine, adding of water, application of active washing substances, structural substances and bleaching agents, agitation of the textiles in the washing solution, pumping off the washing solution, and sequential rinse cycles, the combination therewith of adding the water after loading the textiles in the ratio of 1:4 to 1:30 kg textile to liters water, maintaining the active washing substances in pumpable form, each in a separate container, adding 0.5 to 3.5g of active washing substances and 2 to 6.5g of structural substances per liter of washing water, agitating the textiles at a predetermined temperature for a wash period of up to 50 minutes, pumping off the washing solution, and subjecting the textiles to two to five rinse cycles.

In accordance with the invention there is provided apparatus for a washing process for textiles in an automatic washing machine having a housing, a washing tank, a fresh-water inlet line to the tank, a valve to control the flow of fresh-water, a drain tube connected to the washing tank, a drain pump for discharging liquid from the tank through the drain tube, a discharge line connected to the pump for the discharge of liquid from the tank, the combination therewith of a plurality of separate containers each containing an active substance for the washing process, a number of metering devices with a metering device connected to each separate tube, each metering device having a discharge tube for the discharge of a metered amount active substance from the separate tube, a common pre-mix channel in which the discharge tubes of the metering devices terminate, a water seal connected to the washing tank, and conduit means for flowing liquid from the common pre-mix channel to the water seal from which the liquid flows into the washing tank.

BRIEF DESCRIPTION OF THE DRAWINGS

Other features which are considered as characteristic for the invention are set forth in the appended claims.

Although the invention is illustrated and described herein as embodied in a process for washing textiles in an automatic washing machine, working substances and apparatus for its performance, it is nevertheless not intended to be limited to the details shown, since various modifications may be made therein without departing from the spirit of the invention and within the scope and range of equivalents of the claims.

Figure 1:
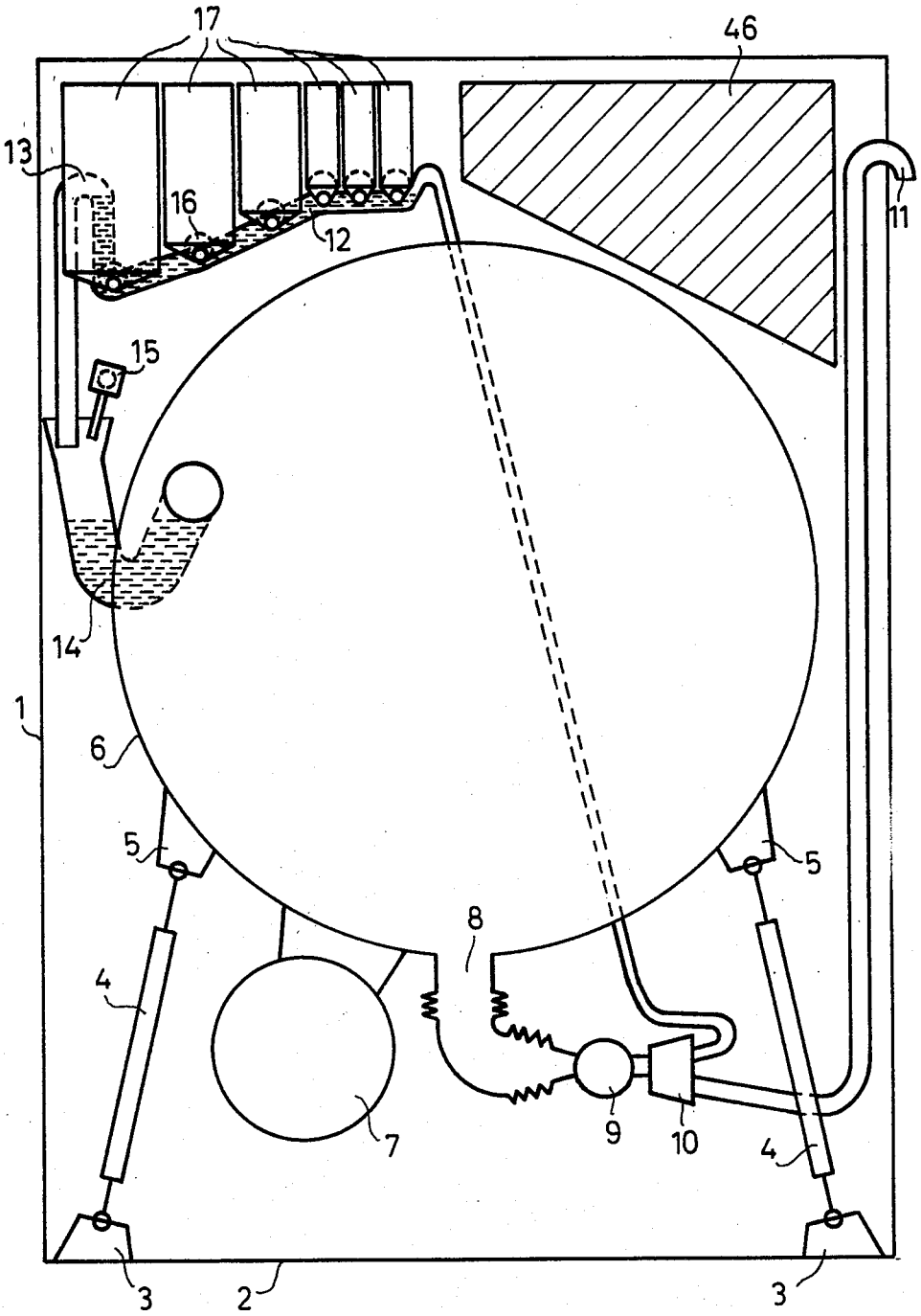
Figure 2:
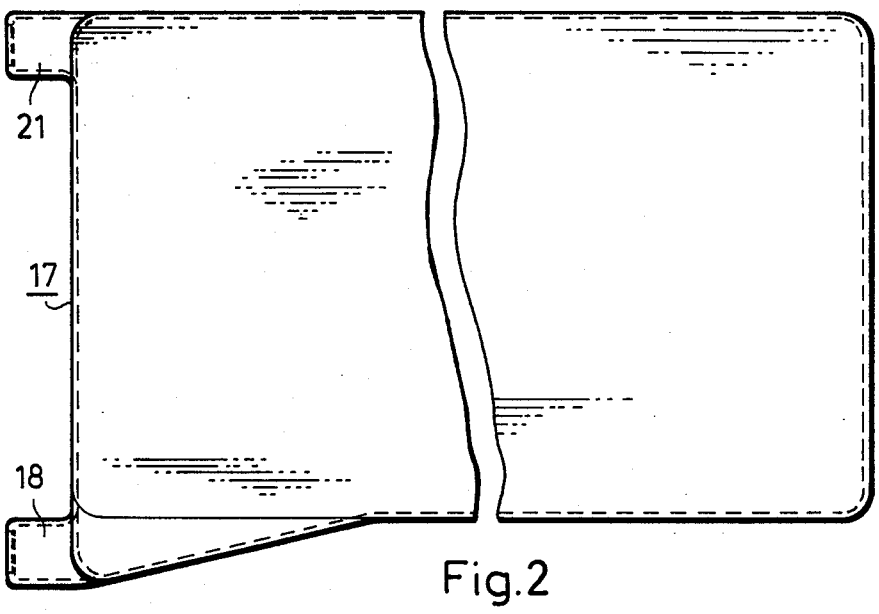
Figure 3:
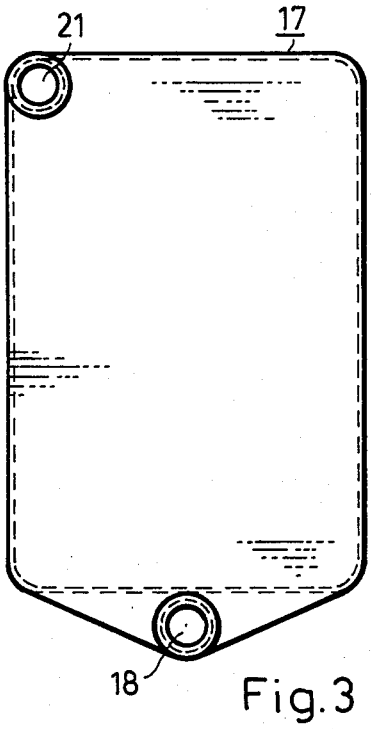
Figure 4:
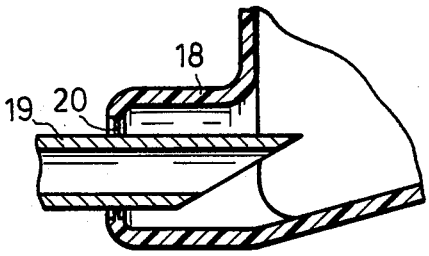
Figure 5:
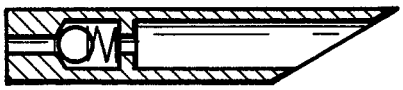
Figure 6:
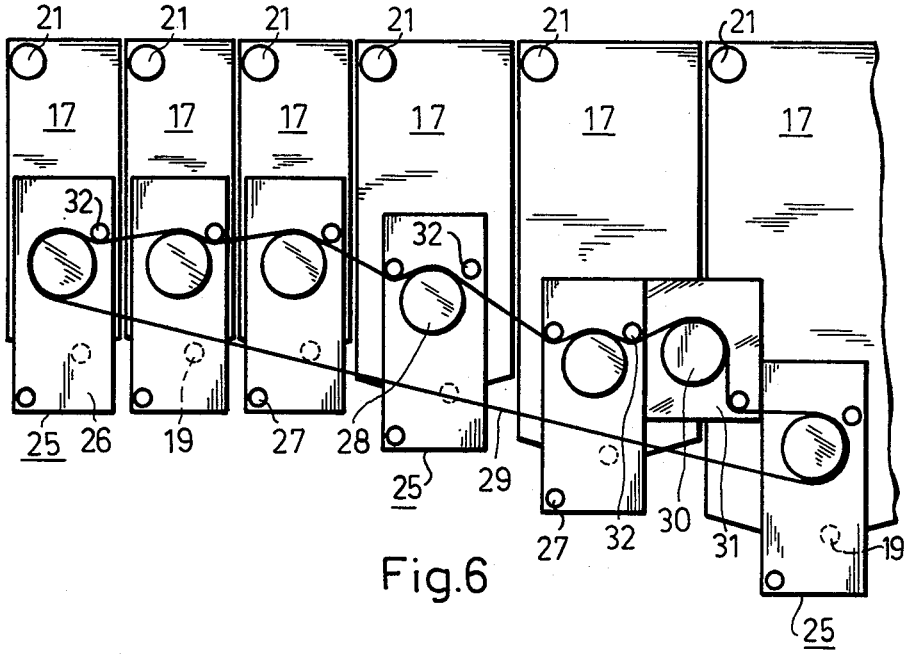
Figure 8:
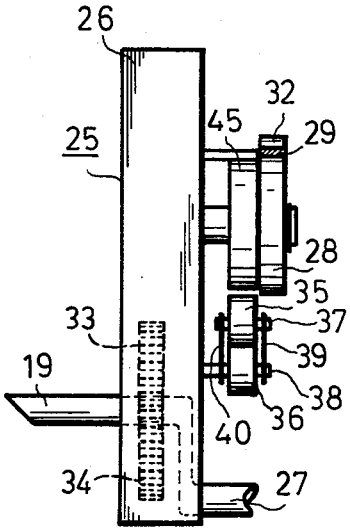
Figure 7:
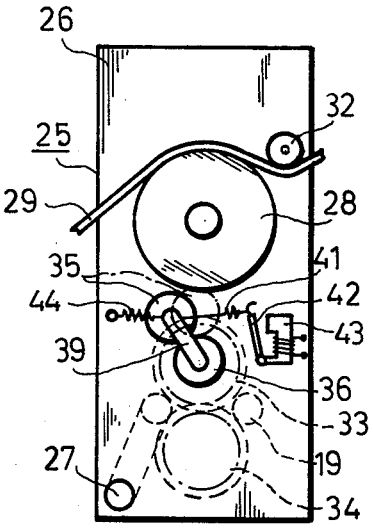
Figure 9:
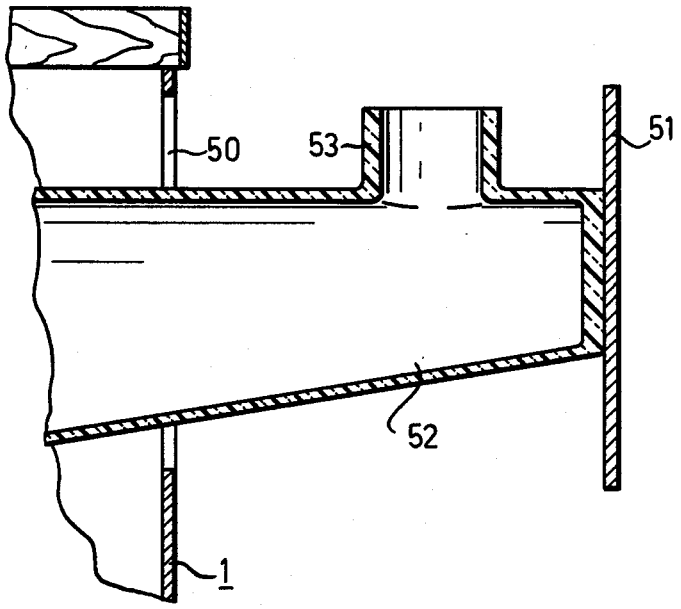

The invention, however, together with additional objects and advantages thereof will be best understood from the following description when read in connection with the accompanying drawings, in which:

FIG. 1 is a front view, schematically presented, of a front-loading drum-type washing machine, with the front wall removed;

FIG. 2 is a side view of a container for the active washing substances;

FIG. 3 is a front view of a container for the active washing substances;

FIG. 4 is an enlarged partial section of an admission tube of a container for the active washing substances;

FIG. 5 shows a vent-tube for a container for the active washing substances;

FIG. 6 is a view of the metering device at the assembled containers for the active washing substances;

FIG. 7 is a rear view of a metering device with drive and clutch;

FIG. 8 is a side view of such a metering device;

FIG. 9 is a sectional view of a pull-out tube for filling a permanently installed container for the active washing substances.

DETAILED DESCRIPTION OF THE INVENTION

The washing process for textiles of the invention is to be carried out in an automatic washing machine under conditions of addition of water and effective agents, relative motion of the laundry with respect to the washing medium, drainage of the wash solution by a pump, and sequential rinse cycles, with the following separate active agents, or combination of agents in a form that can be pumped, introduced in suitable dosage to the washing mixture during the washing process.

1. Active washing substances
2. Structural components
3. A stabilized bleaching agent
4. A catalyst which accelerates the bleaching process, if necessary
5. An organic acid, if necessary
6. A soft rinsing agent, if necessary After loading of the textile materials (laundry) and during the admission of water after the setting of a mixture ratio of kg dry textile material to liters water in the proportion of 1:4 to 1:30, are added 0.5 to 3.5g of active washing substances per liter washing mixture and 2 to 6.5g of structural components per liter washing mixture. The washing temperature is set, the laundry is agitated during an active washing period of up to 50 minutes and two to five rinse cycles are performed in the known manner.

In advantageous form of the process there is added in the first step of the washing process 0.5 to 1.5g of active washing substances per liter mixture and, if necessary, 1 to 3g of structural components per liter mixture. The mixture is set for a temperature up to 60° C, the laundry is agitated relative to the wash solution, and the solution is syphoned off. Fresh water is fed-in in the determined mixture ratio and in the second step of the wash process 0.5 to 2g of active washing substances per liter mixture and 1 to 3.5g of structural components per liter wash mixture are added. The mixture is set to approximately 90° and the laundry is agitated in the liquid during an active wash period of up to 50 minutes.

In an advantageous mode of operation, the second step of the wash process is carried out at a temperature up to 60° C. Preferably, 0.1 to 0.5g of a stabilized bleaching agent are added per liter washing solution mixture. A catalyst is added which accelerates the dissociation of the bleaching agent.

A particularly advantageous feature of the process is achieved by introducing 0.02 to 0.1g of one or several organic acids per liter rinsing mixture during a rinse cycle. It is beneficial to add 0.1 to 0.5g of a soft rinse agent per liter rinse mixture during a rinse cycle.

In the performance of the process according to the instant invention, a suitable working medium for an automatic washing process for textiles is characterized by a combination of the following active substances in a form that can be pumped:

1. active washing substances
2. structural components
3. a stabilized bleaching agent, if necessary, and
4. a catalyst which accelerates the bleaching process, if necessary,
5. an organic acid, if necessary, and
6. a soft-rinse agent, if necessary The active substances listed above are disposed in an arrangement of containers in the washing machine to permit the substances to be separately dispensed. The active substances are fed to the washing process in the following proportion:

0.5–3.5 weight percent of active washing substances
2.0–6.5 weight percent structural substances
0.1–0.5 weight percent stabilized bleach agents, if necessary
a catalyst which accelerates the bleaching process in a stoichiometric amount in reference to the bleaching agent, if necessary
0.02–0.1 weight percent of organic acid, if necessary
0.1–0.5 weight percent of a soft rinse agent, if necessary The active washing substances are substances used to enhance the cleansing action of water and consist primarily of a surface-active agent or surfactant or detergent and include soap, the sodium salt of long-chain acids, synthetic detergents embracing the anionic type, for example, the sodium salts of medium chain-length (7–18 carbons) alkyl sulfates or sulfonates; the cationic type, for example, tetraalkyl ammonium halides; and nonionic type, for example, products made from tall oil by reaction with ethylene oxide to form low-foaming esters.

Examplary compositions of the active washing substance are as follows:

(a)

20–25 weight percent of the sodium salt of straight chain alkyl (($C_{10}$–$C_{13}$) benzene sulfonate
1.2–1.8 weight percent of the sodium salt of toluolsulfonate
8.0–9.5 weight percent of the sodium salt of hardened tallow fatty acid-soap
12.5–16.5 weight percent of the reaction product of tallow fatty alcohol with 11 moles ethylene oxide
9.5–13.0 weight percent isopropanol
0.3–0.5 weight percent NaOH
100.0 weight percent based on the weight of the above components with water of from 0°–14° dH or (b)

13.0–17.0 weight percent of the sodium salt of olefinsulfonate having 16–18 carbon atoms
30.0–35.0 weight percent of the reaction product of oleylalcohol with 10 moles ethylene oxide and 3 moles propylene oxide
2.0–4.0 weight percent of the sodium salt of hardened tallow fatty acid-soap
9.0–11.0 weight percent isopropanol
100.0 weight percent based on the weight of the above components with water of from 0°–14° dH The following combinations are exemplary of compositions of the structural substance or "builder".

(c)

35.0–40.0 weight percent tri potassiumpolyphosphate
0.8–1.8 weight percent Sodium silicate (water glass)
0.5–0.9 weight percent NaOH
100.0 weight percent based on the weight of the above components with water of from 0°–14° dH or (d)

44.0–47.0 weight percent Na-nitrilotriacetate
0.8–1.6 weight percent sodiumsilicate (water glass)
1.0–2.0 weight percent NaOH
100.0 weight percent based on the weight of the above components with water of from 0°–14° dH The bleaching agent advantageously has the following composition:

5.0–10.0 weight percent of $H_2O_2$
0.1–0.15 weight percent dipicolinicacid 100.0 weight percent based on the weight of the above components with water of from 0°–14° dH The presence of N-acetyl-caprolactam as a catalyst serves the purpose of accelerating the bleaching process.

The composition of the organic acid additive may be as follows:

2.0 weight percent citric acid
0.2 weight percent lactic acid
0.2 weight percent acetic acid
100.0 weight percent based on the weight of the above components with water from 0°–14° dH An overdose of complex phosphates, or an underdose of other active substances required for washing as is common with commercially packaged washing agents, can be easily avoided in the present process because the amount of structural substances or phosphates can be adjusted with respect to the water hardness of a particular location according to the manufacturer's instruction when the machine is installed.

Thereby, the unnecessary use of active substances caused by the up-to-now practiced phosphate overdose in soft water areas and the herewith connected pollution of the environment, are avoided. On the other hand, the danger of an underdose of the other substances required for washing is avoided, a danger which arose when less of the complete washing agent recommended by the manufacturer for low water hardness was used.

Since in the present process the active substances of the washing agent are separately dispensed and are in a pumpable form admitted to the washing solution, it is possible to use bleaching systems, stabilized bleaching agents, and catalysts which are fully effective at comparatively low temperatures i.e. at the temperature used for a washing process for fine laundry.

It is now possible by employing the method of the invention to perform a bleaching operation on fine laundry.

The large ballast of perborates present up to now in a fine laundry wash as a result of the use of commercially packaged washing agents are dragged along with the discharge of the wash water into the environment which is polluted thereby. In the process of the invention, hydrogen peroxide is advantageously used as the bleaching agent. The latter dissociates without a residue. The stabilizer to stabilize the hydrogen peroxide and catalyst to dissociate the hydrogen peroxide are only present in comparatively small amounts so that they do not significantly affect the environment. Because of the separate admittance of the various active substances to the washing process, it is furthermore possible to omit the addition of a bleaching agent, in contrast to the now practiced washing procedure of using a complete washing agent even for the pre-wash or soak. Thereby appreciable economy is effected since considerable amounts of active substances are not wasted and, at the same time, the environment is protected from pollution by these substances.

To this can be added that, although the choice of the wash program with respect to strongly, medium or slightly soiled laundry is made by hand, the required amount of active washing substance for the selected program is set to a fixed ratio in the washing machine. Therefore, overdoses which waste active substances and pollute the environment, are avoided.

A further advantage of the process in accordance with the invention versus the known state of the art, is that an effective bleaching system may be used at comparatively low temperatures, and thereby the washing process for heavy and white laundry need not be performed at 90° to 95° C at all times. Washing even heavy and white laundry at 60° C makes considerable savings of energy possible (see Table 2).

Furthermore, by avoiding perborates in the method according to the invention, the danger of a further increase of the boron content of natural waters can be avoided. It should be noted that perborates in appropriate concentration cannot be introduced into the washing process by pump.

Water saving is made possible by the instant invention compared to the known state of the art, since first, an overdose of the washing agent does not take place and second, remaining alkali content in the wash can be absorbed by the addition of organic acids to the rinse cycle or by an acid soft-rinse agent. According to Tables 1, 2 and 3, the water saving can amount to approximately 15%.

As can be seen from Tables 2 and 3, the saving on time and energy in the washing of heavy and fine laundry can amount to approximately 30% in each case, due to the avoidance of an unnecessarily high wash temperature (60° C instead of 95° C).

Thus, with the instant process and the use of the working substances in accordance with the invention the washing of laundry in a washing machine can result in saving a significant amount of time, energy, water and active substances and, at the same time, in reducing the pollution of the environment. A washing process, according to the invention, can be carried out advantageously in an automatic washing machine having a programmed control device, at least one fresh water feed line which is regulated by valves, a pump for the washing solution, and several metering devices for the active washing substances which are controlled by the program control device. A washing machine of this type according to the invention is characterized by having inside of the housing of the machine a plurality of metering devices arranged corresponding to the number of the active substances used, or the combination of active substances used, the intake of such metering devices being connected by a tube with the same number of containers for the active substances, and the discharge of which directly terminates in a common pre-mix channel which is connected over a water trap with the washing tank, and the metering devices having an actuator to which each metering device can be connected if so required. This arrangement according to the invention results in a compactly constructed device which, for example, may be located in a front loading washing machine of the drum type in one of the corners above the drum-shaped washing tank. By the connection of all metering devices to a common pre-mix channel, all discharge lines are wetted long enough by water and a jelling or thickening or crystallization of the active substances or a plugging of the respective parts or tubes of the lines does not occur. Furthermore, by the very short path between the containers for the active substances and the pre-mix channel, the dosing or metering tolerances of the acting wash substances is kept negligibly low.

The containers for the active substances are exchangeably arranged in the machine housing. A short tube is disposed at the lowest part of each container for the active substances at the side that faces the metering devices. The tube points in the direction of the exchange-motion and is provided in the unused state with a skinlike closure or membrane which is perforated by a hollow thorn of the inlet tube of the metering device when the active substance container is placed in the space provided for it for connection with the respective metering device. A ventilation device is provided for each container for the active substances which prevents the escape of air from the container. By this means a later purchase of completely closed or sealed containers for the active substances can be exchanged in a simple way with the emptied containers in the machine, without anybody coming in contact with the contents of the container.

In another embodiment the containers for the active substances are arranged in a fixed position in the machine housing and are each provided with a refill tube. By arranging the containers for the active substances in a fixed position a cost saving configuration for the container holders and their connection to the metering devices is made possible.

For best results, the metering devices comprise gear-pumps which are each connected over an electrically controlled clutch to a common drive motor. This is advantageous because gear pumps permit at sufficiently low pump rates, time controlled accurate metering or dosing of liquids of almost any viscosity. Electrically operated small clutches react fast enough and keep the technical complexity of the metering devices and the controls for the latter within reasonable limits.

Since the common pre-mixing channel is connected, on one side, with the pressure side of the washing solution pump or main pump and on the other side by an overflow arch with the water trap or seal, the danger of a thickening and crystallizing of the washing substances in the discharge tubes of the metering devices is eliminated. The reason for this is that the overflow arch prevents the water which is in the pre-mix channel from running off when no further liquid is fed in from one side, thus maintaining a body of water in the channel. The connection of the pre-mixing channel with the wash-solution pump permits the addition of an active substance into the washing solution during any phase of the washing cycle without cooling the already warm washing solution by the new addition of cold fresh water.

The formation of an hydraulic jump, which is required in a further development of the invention, in order to avoid sucking back the added water, can be best achieved by ending the fresh water admission line directly in the water trap over a hydraulic jump or water-jump.

The device of the invention works well with all liquid washing agents of almost any viscosity. During refilling of the used-up washing agents spilling from the container and contact with the chemical substances is improbable.

Household washing machines are often idle for long-time periods and jelling or crystallizing of the washing substances in the tubes and connecting lines should not occur. In the present process only such amounts of active wash agents are admitted automatically to the washing process so that almost no unused wash substances are contained in the drain water. This requires very accurate metering which must not depend on the pressure of the fresh water line. This is achieved in a washing machine according to the instant invention. Furthermore, the washing machine according to the invention can have the conventional dimensions for the household i.e. the devices for storage and metering of the active wash substances can be installed in a washing machine housing of the presently conventional dimensions of 60 × 60cm standing area and 85cm height.

The known anionic, cationic and non-ionic detergents and betaine may be used as active washing agents as part of the working substances which are added to the wash water mixture in a pumpable form in metered doses during the wash process. Examples are: alkylbenzenesulfonates such as straight chain alkali alkylbenzenesulfonate with 10 to 14 C-atoms in the alkyl chain, with the maximum at $C_{12}$; alkali-alkanesulfate with a chain length of 14 to 18 C-atoms; alkaliolefinsulfonate of α-olefins with 12 to 20 C-atoms chain length; alkali salts of sulfuric acid ester of higher molecular weight alcohols with 10 to 20 carbon atoms in the alkyl chain or synthetic fatty acids with 10 to 20 carbon atoms; ester of sulfo-sebaci acid alkali salts and carboxylates of fatty-alcohol-oxyethylates.

Non-ionizable detergents are oxyethylates from natural or synthetic fatty-alcohols containing 10 to 20 carbon atoms, fatty acids of natural or synthetic origin containing 12 to 18 carbon atoms or fatty acids amides or alkylphenols which contain 8 to 10 carbon atoms in the alkyl chain. The oxyethyl content of the oxyethylates must be so proportioned that the hydrophylic-hydrophobic balance is maintained. The compounds can also additionally be propoxylated. As examples are to be mentioned: (tallow) fatty alcohol oxyalkylated with 8 to 12 mol ethyleneoxide and 2 to 4 mol propyleneoxide. The ethylene oxide and propylene oxide can be used as a mixture.

For a better washing effect in general, one will use the non-ionizable detergents with the above-mentioned anionic active detergents in the weight ratio known in washing technology. It is useful to add the usual foam-suppressing substances, as for example alkalisalts of hardened tallow-fat acids, with 4 to 6% behenic acid in the fatty acid composition and a titer of 39° to 41° C, fatty alcohols with 12 to 18 C-atoms and their oxyethylated derivates, melanin derivates and endposition blocked fatty alcoholethylates. If alkylbenzosulfates or alkanesulfonates are used as anionic substances, it is recommended to add hydrotropic substances such as short chain alkyl-benzenesulfonate, for example, alkali-toluolsulfonate or alkali-cumolsulfonate in amounts of 0.5 to 1.0 weight percent referred to anionic substances as dissolving intermediary. Also small parts of low molecular alcohols such as 8 to 15% isopropanol can improve the solubility of the detergents mixture.

In order to use the active washing substances as well as other agents which may be added in addition, such as optical brighteners, perfume, color and preservation agents in a pumpable form, they must contain suitable amounts of water, generally 30 to 60 weight percent water, based on the weight of the total pumpable solution.

When enzymes are to be used to improve the cleaning effects, a pumpable mixture of the active washing substances and the enzymes in a water-free carrier such as glycols or alcohols are required. Also, for some cases, mixtures of the active washing substances, non-ionic and cationic detergents, can be used and can achieve special effects.

For structure substances or builders known compounds are used which have complex forming properties, such as tripolyphosphates, pyrophosphates, nitrogen containing polycarbonic acids, polycarbonic acids, carbooxamides, tenside with builder properties, inorganic water soluble salts, and also heterogenic organic and inorganic builders of the type of the alkali-aluminumsilicates or polyacrylic acid.

In order to give the washing mixture certain alkalinity, which aids the cleaning effect, one will add to the structural substance, 2 to 8 weight percent based on the amount of structural substance, of alkalis such as NaOH, KOH or amines, and also 8 to 15 weight percent alkali-silicates. In order to use the structural substances in pumpable form, they must contain sufficient amounts of water, generally 40 to 60%, based on the total pumpable solution.

$H_2O_2$ with a stabilizer is usually used as bleaching agent and is, in practice, stored in the washing machine in high concentration with approximately 7% water, although lower concentration can also be used. Suitable stabilizers are organic acids as, for example, pyridine-carboxylic acids, particularly dipicolinic acid. The bleaching agent should be added after the wash-temperature has been reached. A catalyst which accelerates the bleaching process is, for example, N-acetyl-caprolactam; also suitable are a great number of acylating agents, such as N-acylamide, acylhydroxyamine or N-acylsulfoamide. These substances will be added in stoichiometric amounts.

For organic acids for making the rinse process acidic, one may choose for example, formic acid, acetic acid, lactic acid or citric acid or a mixture of the acids.

As soft rinsing agents the cationic active substances, known for this purpose, can be used but also products similar to cationic substances, for example, the condensation products of one base organic acids having at least 16 to 18 C-atoms and an amine, as for example, N-oxethylpropandiamine. It is advantageous to mix the soft rinse agent with one or several organic acids, for example, acetic acid, lactic acid, citric acid in amounts of 15 to 25 weight percent based on the soft rinse agent. Glycols or low molecular alcohols may be added to improve the solubility. Furthermore, the soft rinse agent may contain bacteriostatic and bactericidal additions and an optical brightener.

The composition of the above-mentioned active substances must be such that their pumpability is maintained over long periods of storage.

With respect to the amount of active washing agents, it is desirable to add for washing slightly soiled laundry in a single wash solution process 0.5 to 1.5g active substances per liter washing water; for average soiled laundry 1 to 2.5g per liter washing water and for very soiled laundry 2 to 3.5g per liter of washing water. In a double wash solution process, the amount of active washing substances to be added is introduced in parts.

With respect to the structural components that are used, one proceeds in an analogous manner, i.e. when washing slightly soiled laundry in a one solution process, 2 to 3.5g of structural substances are to be added per liter, for average soiled laundry 3 to 4.5g per liter and for very soiled laundry 4 to 6.5g per liter washing solution. In a double wash cycle process, the total amount of structural substances is added in parts.

For washing of heavy white laundry, it is recommended to wash with a wash solution ratio of 1:4 to 1:5 i.e. kg laundry to liters water, while for more delicate laundry, a wash solution ratio of 1:10 to 1:25 is selected and for wool, a ratio of 1:20 to 1:30 is set. In special machine constructions it could also be feasable to use even smaller amounts of water, with respect to the amounts of laundry.

In areas of soft water (0 to 7 dH) when using complex phosphates as structural components, it is recommended to choose a ratio of phosphate to active washing substances of 1:1 to 1.5:1, in areas of medium water hardness (7 to 14 dH) a ratio of phosphate to active washing substances of 1:1 to 2.5:1 and in hard water areas (from 14 dH on) a ratio of phosphate to active washing substances of 2:1 to 3:1. The adjustment of these weight ratios is best done at the installation of the washing machine. A suitable arrangement in an automatic washing machine is described with the aid of FIGS. 7 and 8.

The washing temperature for heavy and white laundry can be up to 90° boiling temperature, however, for saving energy it is advantageous to work at 60° C. For washing colored laundry, it is recommended to operate the process at 30° to 60° C, while fine and delicate laundry is best treated at 30° to 60° C.

The process according to the instant invention can be used in so-called laundromats and coin automats and other places.

The following examples and comparative examples illustrate the present invention and the technical progress which it can achieve:

Composition of the combinations of active components used in accordance with the invention 1. Active substances with added components
   Active substance combination $A_1$:
   - 22.5 weight percent sodium salt of the straight chain alkylbenzenesulfonate
   - 1.4 weight percent toluolsulfonate
   - 9.0 weight percent sodium salt of hardened tallow fatty acid-soap
   - 14.5 weight percent of the reaction product of tallow fatty alcohol with 11 moles of ethylene oxide
   - 11.0 weight percent isopropanol
   - 0.4 weight percent NaOH
   - 100.0 weight percent based on the weight of the above components with water of 12° dH The alkyl is a mixture of 5% $C_{10}$, 15% $C_{11}$, 45% $C_{12}$, 35% $C_{13}$ Active substance combination $A_2$:
   - 15.2 weight percent sodium salt of olefinsulfonate (C-chain length $C_{16} - C_{18}$)
   - 33.0 weight percent of the reaction product oleylalcohol with 10 moles ethylene oxide and 3 moles propylene oxide
   - 3.0 weight percent sodium salt of hardened tallow fatty acid-soap
   - 10.0 weight percent isopropanol
   - 100.0 weight percent based on the weight or the above components with water of 12° dH
2. Structural Substances
   Active Substance Combination $B_1$:
   - 37.8 weight percent tri potassium polyphosphate
   - 1.5 weight percent sodium silicate (water glass)
   - 0.7 weight percent NaOH
   - 100.0 weight percent based on the weight of the above components with water of 12° dH Active Substance Combination $B_2$:
   - 46.0 weight percent Na-nitrilotriacetate (NTA) (Trilon A)
   - 1.2 weight percent sodium silicate (water glass)
   - 1.5 weight percent NaOH 100.0 weight percent based on the weight of the above components of water of 12° dH 3. Stabilized Bleaching Agent
   Active Substance Combination C:
   7.0 weight percent $H_2O_2$
   0.1 weight percent dipicolinicacid
   100.0 weight percent based on the weight of the above components with water of 12° dH
4. Catalyst which accelerates bleaching process
   Active Substance D:
   100.0 weight percent N-acetyl-caprolactam
5. Organic Acid
   Active Substance Combination E:
   2.0 weight percent citric acid
   0.2 weight percent lactic acid
   0.2 weight percent acetic acid
   100.0 weight percent based on the weight of the above components of water of 12° dH
6. Soft Rinsing Agent:
   Active Substance Combination F:
   6.0 weight percent condensationproduct of stearic acid and N-oxethylpropandiamine
   3.0 weight percent 1,2-propyleneglycol
   1.0 weight percent citric acid
   0.1 weight percent lactic acid
   0.1 weight percent acetic acid
   100.0 weight percent based on the weight of the above components with water of 12° dH The following comments are made with respect to the evaluations which were performed.

A man well experienced in the art knows how difficult it is to define in numbers the washing power and the cleaning capability of a washing process and/or active agents for washing or a combination of the latter. The differences in the kind and washability of the dirt and the kind of fiber and the textile surface etc. contain many uncertain factors so that several measuring methods, in some cases applied at the same time, give the best result according to the present state of the art.

1. For white laundry which is boiled, the evaluation is done by a group of trained people, whereby care is taken that approximately equally soiled pieces of laundry are selected from various professional and social strata. Before and after the washing process, the laundry is evaluated by the same group of people. Only the degree of absolute cleanliness is ascertained and the number of clean pieces recorded. Thereby the evaluation is strictly "clean" and "not clean"; even the smallest spot or shading of large pieces of laundry, for example bed linen, are judged a "not clean". In conjunction with the evaluation, also the percentage of clean pieces is given; the higher the percentage, the more successful the washing process. Each experiment is repeated 25 times.

A visual evaluation by a larger group of people is also performed, for fine and woolen laundry and also for men's shirts. In men's shirts, particularly the collar and the cuffs are examined. In this case, no percentual evaluation is performed but the appearance is evaluated with grades "very good", "good", "almost good" and "satisfactory".

Besides these criteria for the evaluation of the result of wash processes according to DIN 44 983, the primary washing effect is evaluated with artificially soiled test fabrics of the "Wäschereiforschung Krefeld e.V. (WFK)" and of the "Eidgenossigen Material Prüfungsanstalt St. Gallen (EMPA)". The secondary washing effects have been measured with immedial green colored cotton fabrics for determination of the bleaching intensity of the washing process: with standard-cotton stripe and terry cloth for determination of the degree of whiteness, grayness, damage factor, content of ashes and calcium.

EXAMPLE 1

After filling of the machine with 4 kg of soiled household laundry and a few small test rags and after setting a washing mixture ratio of ~1:5 with water of 18° dH, in the first step were added 24g of active washing substances in the combination form $A_1$ and 70g tri potassium polyphosphate in combination form $B_1$. The washing solution was heated 40° to 50° and the drum agitated back and forth. Then the washing solution was siphoned off and fresh water of 18° dH was fed-in in a mixture ratio of ~1:5. Then in the second step, 20g active washing substances (combination $A_1$) and 65g K-tripolyphosphate (combination $B_1$), the mixture was heated to 95° C and the drum reversingly agitated for another 20 minutes. After reaching the maximal washing temperature in the second step there were introduced 2.0g $H_2O_2$ 100% with water and 0.1 weight percent di-picolinic acid, stabilized $H_2O_2$ solution (combination C). After this washing period, the machine was filled with fresh water to the rinse level and was rinsed four times with fresh water with a mixture ratio of ~1:6. To the last rinse cycle were added in the form of active substance, combination F, 3g of a condensation product of a stearic acid and N-oxethylpropandamine, which was adjusted to a pH-value of 2.2 with 1 weight percent of citric acid and 0.1 weight percent lactic acid and 0.1 weight percent of acetic acid.

Comparison Example 1

For comparison purposes the following process illustrating the known state of the art was carried out in a conventional drum-type washing machine:

4 kg of soiled household laundry and a few small test rags were loaded into the washing machine, the program "boiled laundry" was selected and the machine was set for a mixture ratio ~1:5 with water of 18° dH. At the same time the first chamber of the dish provided for this purpose was filled with 135g of a popular commercial wash powder following the printed instructions on the carton.

The washing mixture was heated to approximately 45° C and the wash process was performed with an oscillating motion of the drum for 20 minutes. Then the washing mixture was siphoned off, again the washing mixture ratio was set for ca. 1:5 with fresh water of 18° dH and through the second chamber of the soap dish another 135g were added for the second washing step. The washing mixture was heated to 95° C and the drum was oscillated at this temperature. Then fresh water was admitted up to a mixture ratio of ca. 1:6 for five rinse cycles and in the last rinse 60 ml of a commercial soft rinse agent were added.

The visual evaluation of the results of the wash processes of Example 1 and Comparison Example, as previously outlined, is as follows:

Visual Evaluation of washings: Example 1, (process according to the invention) = 85% ± 1,2 Comparison Example, (state of the art) = 84% ± 1,9

The evaluation of the various test rags washed was performed and gave the results shown in the table below:

| Examination as per DIN 44 983 | | |
|---|---|---|
| Washed test fabric | Example 1 (according to the invention) | Comparison Example (State of the art) |
| WFK (Laundry Research Krefeld) | 67,8 ± 1,0 | 72,8 ± 0,4 |
| EMPA (Fabric test laboratory St. Gallen) | 52,3 ± 0,9 | 50,4 ± 0,4 |
| Bleach intensity | 33,3 | 46,1 |
| Greying - Wo Standard | 2.8 | 0.4 |
| Greying - Wo - Terry cloth | 5.8 | 4.6 |
| Degree of whiteness after 25 washings | 105.2 | 103.0 |
| Damage factor | 0.1 | 0.2 |
| Ash Standard | 0.2% | 0.2% |
| Ash Terry cloth | 0.2% | 0.3% |
| Alkalinity of Rinse | 0.1 | 0.5 |

Ca-deposit, flame photometric measurement (Evaluation after 5, 10, 20 and 25 washings)

| | | | | | | |
|---|---|---|---|---|---|---|
| Example 1 (according to the invention): | washes | 5 | 10 | 15 | 20 | 25 |
| | ppm Ca | 630 | 650 | 610 | 750 | 850 |
| Comparison Example 1 (state of the art): | washes | 5 | 10 | 15 | 20 | 25 |
| | ppm Ca | 650 | 630 | 615 | 730 | 900 |

From the above results it can be seen that equally good washing results can be achieved using the process according to the invention in conjunction with the working substances of the invention (Example 1) with, however, a saving of active substances and reduced pollution, compared to the results by using conventional washing process and working substances of the known state of the art (Comparison Example 1).

EXAMPLE 2

As in Example 1, 4 kg of soiled household laundry was loaded into the washing machine, the washing mixture ratio was also set to ~1:5 with water of 18° dH, and in the first step 24g of active washing substance was added in the form of substance combination $A_1$, and also 70g of tri potassium polyphosphate were added in the form of substance combination $B_1$. The washing mixture was heated to 45° C while the drum was oscillating. Then the mixture was pumped off and fresh water was introduced to a washing mixture ratio ~1:5. In the second step, the used dosage was the same as in Example 1 with 20g active washing substance and 65g K-tripolyphosphate added, however the washing mixture was only heated to a washing temperature of 60° C and the drum was oscillated for 40 minutes in an extended active washing period. The steps which followed were performed as described in Example 1. Additionally, together with the $H_2O_2$ solution, 7g N-acetylcaprolactam was added as an agent to accelerate the bleaching process.

Comparison Example 2

In the experiment performed for comparison, soiled household laundry as in Comparison Example 1, was washed in an active washtime extended to 40 minutes but only at 60° C.

The evaluation of these wash experiments gave the following results:

Visual evaluation of laundry: Example 2 (process according to the invention) = 82% ± 2.2 Comparison Example 2 (state of the art) = 61% ± 3.5

| Evaluation per DIN 44 983 | | |
|---|---|---|
| Washed test fabric | Example 2 | Comparison Example 2 |
| WFK | 59.5 ± 1.1 | 62.2 ± 1.2 |
| EMPA | 43.1 ± 0.9 | 44.7 ± 0.6 |
| Bleaching intensity | 54.1 | 18.7 |
| Greying Wo Standard | 1.5 | 1.4 |
| Greying Wo - Terry cloth | 6.4 | 7.2 |
| Degree of whiteness after 25 washings | 102.8 | 105.4 |
| Damage factor | 0.0 | 0.1 |
| Ash Standard | 0.1% | 0.6% |
| Ash Terry cloth | 0.2% | 0.3% |
| Alkalinity of rinse | 0.1 | 0.4 |

Ca-deposit, measured by flame photometry Evaluation after 5, 10, 15, 20 and 25 washes

| | | | | | | |
|---|---|---|---|---|---|---|
| Example 2 | washes | 5 | 10 | 15 | 20 | 25 |
| | ppm Ca | 660 | 730 | 550 | 610 | 550 |
| Comparison Example 2 | washes | 5 | 10 | 15 | 20 | 25 |
| | ppm Ca | 610 | 780 | 600 | 650 | 710 |

As shown by the results equally good values were given by visual evaluation of soiled laundry done at a washing temperature of 60° C according to the invention (Example 2) as compared with laundry done at 95° C according to the known state of the art (Comparison Example 2).

Laundry cannot be done at 60° C according to the state of the art because no satisfactory result can be achieved with respect to the removal of stains. As already explained, the perborates contained in the wash powders, according to the known state of the art, are not effective at 60° C. In this comparison example, the amount of stained laundry was approximately 40%. According to the type of household this amount and this percentage of washing to be re-done might even be considerably higher. Thus, the working process according to the invention and using the active substances according to the invention, make considerable savings possible of time, energy (~30%) and water (15%), when washing soiled household laundry (see Table 2).

EXAMPLE 3

The same procedure as in Example 2 was followed, i.e. 4kg soiled household laundry was washed in a two-step process with the same dosage of active washing substances and structural substances at the same temperatures. However, in contrast to Example 2, the active washing time in the second step was only 20 minutes i.e. the extended active washing time of Example 2 was not used. Otherwise the procedure was as described in Example 1.

The evaluation of this washing had the following results: Evaluation per DIN 44 983

Visual evaluation of laundry: Example 3 (process according to the invention) = 77% 3.2

| Evaluation per DIN 44 983 | | |
|---|---|---|
| Washed test fabric | Example 3 | |
| WFK | 58.5 | 1.1 |
| EMPA | 37.3 | 1.2 |
| Bleach intensity | 49.3 | |
| Greying Wo Standard | 1.2 | |
| Greying Wo Terry cloth | 6.1 | |
| Degree of whiteness after 25 washes | 103.4 | |
| Damage factor | 0.3 | |
| Ash Standard | 0.2% | |
| Ash Terry cloth | 0.2% | |

-continued

| Evaluation per DIN 44 983 | |
|---|---|
| Washed test fabric | Example 3 |
| Alkalinity of rinse | 0.1 |

As the values show, the washing process according to the invention can be carried out at 60° C with satisfactory washing results and excellent stain removal results.

A washing process according to the known state of the art does not give satisfactory results for removing stains and therefore must be considered as unsatisfactory.

EXAMPLE 4

Approximately 1 kg = 5 pieces, partly very soiled man's outer shirts, no-iron (cotton/polyester in a ratio of 1:1) were loaded into the washing machine and the machine was adjusted for a washing mixture ratio of approximately 1:25 with water of 18° dH. In the first step of the washing process 25g of active washing substances in the form of substance combination $A_2$ and 80g nitrilotriacetate in the form of substance combination $B_2$ were added, then heat was applied to 30° C and the drum oscillated. The washing mixture was pumped off, the drum was filled with fresh water of also 18° dH, filled to a washing mixture ratio of 1:22 and in the second step 25g of active washing substances in the form of substance combination $A_2$ and 80g nitrilotriacetate in the form of substance combination $B_2$ were added and the drum was oscillated for 10 minutes more after the washing mixture was heated to 60° C. After reaching the water temperature in the second step 2.0g of $H_2O_2$ in the form of stabilized $H_2O_2$ solution with 0.1 weight percent dipicolinic acid as in the form of the substance combination C is added, and also 12g N-acetylcaprolactam is added as the agent to accelerate the bleaching process. After the end of the washing period the wash mixture is cooled in steps by pendulum-rinsing, then pumped off and twice rinsed with fresh water with a mixture ratio of 1:25.

Comparison Example 4

For comparison the following procedure was carried out in a conventional drum-type washing machine according to the known state of the art: approximately 1 kg = 5 pieces, also partly badly soiled men's shirts of the same fabric quality and worn by the same group of people, as described in Example 4, were loaded into a washing machine. After setting the program "60° C, iron-free", the machine was filled with fresh water of also 18° dH at a washing mixture ratio of approximately 1:25. At the same time 135g of commercially marketed washpowder was filled into the chamber of the washpowder basket provided for this purpose. After a wash period of 15 minutes during which the washing mixture reached a temperature of 38° C, the mixture was siphoned off and the machine again filled with fresh water for the second washing step, whereby again 135g of the washing powder was added from the second chamber. The washing temperature was 60° C, the active wash period 10 minutes. After the washing period the process was carried out as in Example 4.

The method previously described for evaluation of this wash experiment was used. The appearance was marked with the grades "very good", "good", "almost good" and "satisfactory".

After 25 washings:

Example 4 (process according to the invention)
- Collars = almost good
- Cuffs = good Shirts without spots
- Overall grade = good Comparison Example 4 (known state of the art)
- Collars = almost good
- Cuffs = almost good Shirts without spots
- Overall grade = almost good The evaluation of the various test rags was performed as described previously and gave the results shown in the table below:

| Evaluation per DIN 44 983 | | |
|---|---|---|
| Washed fabric | Example 4 | Comparison Example 4 |
| Mixed fabric*, WFK dirtied | 58.7 ± 0.8 | 49.1 ± 1.4 |
| EMPA | 45.8 ± 0.8 | 42.0 ± 0.8 |
| Bleach intensity | 23.4 | 12.4 |
| Greying Wo Standard | 3.3 | 0.0 |
| Greying Wo terry cloth | 7.6 | 5.8 |
| Degree of whiteness after 25 washings | 99.0 | 108.6 |
| Damage factor | 0.0 | 0.0 |
| Ash Standard | 0.1% | 0.2% |
| Ash terry cloth | 0.2% | 0.3% |
| Alkalinity of Rinse | 0.1 | 0.1 |

*Mixed fabric, cotton: polyester 1:1

Ca-Deposit, measured flame photometric
Evaluation after 5, 10, 15, 20 and 25 washings

| | | | | | | |
|---|---|---|---|---|---|---|
| Example 4 | washes | 5 | 10 | 15 | 20 | 25 |
| | ppm Ca | 490 | 480 | 440 | 480 | 420 |
| Comparison Example 4 | washes | 5 | 10 | 15 | 20 | 25 |
| | ppm Ca | 500 | 500 | 510 | 520 | 520 |

From the test results can be seen that by the process according to the invention and in conjunction with working substances according to the invention (Example 4), not only is there a saving of working substances and reduced pollution, but also better results are obtained then by the conventional process using working means according to the state of the art (Comparison Example 4).

Table 1

| | Example 1 and Comparison Example 1 | | | | | |
|---|---|---|---|---|---|---|
| | Washing process Known state of art | | | Washing process According to invention | | |
| | Temp. (° C) | Total Wash time (min.) | water (l) | Temp. (° C) | Total wash time (min.) | water (l) |
| Pre washing | 45 | 20 | ca. 20 | 45 | 20 | ca. 20 |
| Main washing process | 95 | 60 | ca. 10 | 95 | 60 | ca. 10 |
| 1. Rinse | ~ 60 | ↓ | ↓ | ~ 60 | ↓ | ↓ |
| 2. Rinse | ↓ | ↓ | ↓ | ↓ | ↓ | ↓ |
| 3. Rinse | ↓ | 30 | ca. 100 | ↓ | 24 | ca. 80 |
| 4. Rinse | ↓ | ↓ | ↓ | ~ 15 | ↓ | ↓ |
| 5. Rinse | 15 | | ↓ | — | — | — |
| Spin | | 6 | | | 6 | |
| Total | | 116 | ca. 130 | | 110 | 110 |

Table 1-continued

| | Example 1 and Comparison Example 1 | | | | | |
|---|---|---|---|---|---|---|
| | Washing process Known state of art | | | Washing process According to invention | | |
| | Temp. (° C) | Total Wash time (min.) | water (l) | Temp. (° C) | Total wash time (min.) | water (l) |
| Energy (kWh) | | ~ 3.0 | | | ~ 3.0 | |

Table 2

| | Example 2 and Comparison Example 1 | | | | | |
|---|---|---|---|---|---|---|
| | Washing process Known state of art | | | Washing process According to invention | | |
| | Temp. (° C) | Total wash time (min.) | water (l) | Temp. (° C) | Total wash time (min.) | water (l) |
| Pre washing | 45 | 20 | ca. 20 | 45 | 20 | ca. 20 |
| Main washing process | 95 | 60 | ca. 10 | 60 | 50 | ca. 10 |
| 1. Rinse | ~ 60 | ↓ | ↓ | ~ 35 | ↓ | ↓ |
| 2. Rinse | ↓ | 30 | ca. 100 | ↓ | 24 | ca. 80 |
| 3. Rinse | ↓ | ↓ | ↓ | ↓ | ↓ | ↓ |
| 4. Rinse | ↓ | ↓ | ↓ | ~ 15 | | ↓ |
| 5. Rinse | ~ 15 | ↓ | ↓ | — | — | — |
| Spin | | 6 | | | 6 | |
| Total | | 116 | ca. 130 | | 100 | ca. 110 |
| Energy (kWh) | | ~ 3.0 | | | ~2.0 | |

Table 3

| | Example 3 and Comparison Example 1 | | | | | |
|---|---|---|---|---|---|---|
| | Washing process Known state of art | | | Washing process According to invention | | |
| | Temp. (° C) | Total wash time (min.) | water (l) | Temp. (° C) | Total wash time (min.) | Water (l) |
| Pre washing | 45 | 20 | ca. 20 | 45 | 20 | ca. 20 |
| Main washing process | 95 | 60 | ca. 10 | 60 | 30 | ca. 10 |
| 1. Rinse | ~ 60 | ↓ | ↓ | ~ 35 | ↓ | ↓ |
| 2. Rinse | ↓ | ↓ | ↓ | ↓ | ↓ | ↓ |
| 3. Rinse | ↓ | ↓ | ↓ | ↓ | 24 | ca. 80 |
| 4. Rinse | ↓ | 30 | ca. 100 | ↓ | ↓ | ↓ |
| | | ↓ | ↓ | ~ 15 | | |
| 5. Rinse | ~ 15 | | | — | — | — |
| Spin | | 6 | | | 6 | |
| Total | | 116 | ca. 130 | | 80 | ca. 110 |
| Energy (kWh) | | ~ 3.0 | | | ~ 2.0 | |

The washing machine shown schematically in FIG. 1 has a housing 1 with bottom part 2, to which fastening devices 3 for the spring legs 4 are provided. The spring legs 4 are connected at their upper ends by suitable fastening devices 5 with the washing mixture tank 6 of the washing machine. The drum which is disposed horizontally in the washing machine is not shown for clarity. In the lower zone of tank 6 are disposed a drum drive motor 7 and a drain tube 8 of the tank 6. Drain tube 8 is connected by an elastic tube with the mixture pump 9, the pressure side of which is connected to a regulating control valve 10 with one side of the valve 10 connected to the pre-mix channel 12. Control valve 10 directs the flow of liquid to either pre-mix channel 12 or discharge line 11. The other side of the pre-mix channel 12 has an overflow arch 13 resembling an inverted U tube, which terminates in a water seal or trap 14. In this embodiment the fresh water intake line which is controlled by a single valve 15, also ends in this water seal. By virtue of the instant invention the great number of valves and water-directing means which were required in multi-chambered substance containers in the known state of the art are made superfluous.

The required containers 17 for the active substances are connected to the pre-mix channel 12, for example, metering devices are shown schematically in FIG. 1. The containers 17 for the active washing substances are so staggered in size that according to their statistically distributed frequency of use in the washing programs all containers will be emptied at the end of a planned refilling time. For example, for six containers 17, a volume ratio of 8:4:2:1:1:1 results.

The corner space above the drum-shaped container 6 for the washing solution which is not occupied by the storage and metering device 46 is shown cross-hatched in the figure, and can be used for the switching and controlling devices of the washing machine. In corner 46 may also be disposed the conventional program-control device which is neither shown nor described in detail. In washing machines that have a raised superstructure at the backside of the coverplate, some parts of the storage and metering devices can also be located there.

The sequential events of a washing program according to the invention may be as follows:

After the machine has been loaded with the materials to be washed, valve 15 turns on the fresh-water-admission line. The fresh water enters over water seal 14 into the washing solution tank 6 and wets the materials to be washed, while the drum is moved several times with a reversing motion. In the case that a pre-wash period is provided in the selected wash program, the water in the solution tank may be heated to a low pre-washing temperature. Then the warmed water is transported by the washing solution pump 9 and directing means 10 to the pre-mix channel 12. Simultaneously, or a short time before, one or several active substances which are separately stored in the containers 17 for the active wash substances are introduced into the pre-mix channel 12 in amounts which are exactly predetermined by the machine program, for example, by an impulse length selector which is controlled by the program. The circulating water thus flushes the required amounts of active wash substances into the wash solution tank until all the active wash substances remaining in the pre-mix channel 12 are uniformly distributed in the circulating water. Furthermore, the discharge tubes which end into the pre-mix channel are always wetted and therefore do not get plugged up. The metered amount of the active wash substances is just sufficient to perform its function during the pre-wash period. Venting devices which are not shown, can be provided on each side of the pre-mix channel to avoid the water being sucked back from the pre-mix channel 12 by gravity in one or the other direction, after the solution pump is stopped.

At the end of the pre-wash process the used-up washing solution can be siphoned off through the switched directing means 10 and the discharge arrangement 11 without concern because there are hardly any unused amounts of active wash substances in the drain water. Therefore the washing machine can be operated without excessive use of active wash substances and the environment is not polluted which previously was unavoidable.

At the beginning of the clear-wash, fresh water is again admitted through valve 15 until the required water level is reached in the washing solution tank. After the washing solution is heated to the temperature predetermined by the machine program the washing solution can be again pumped from the tank through the pre-mix channel 12. Again, predetermined amounts from one or several of the containers 17 for the active wash substances can be discharged into the pre-mix channel 12 and are transported by the circulating wash solution into the washing solution tank 6. At the end of the washing period the washing solution, after being optimally utilized, is removed from the machine by the discharge arrangement 11.

In a similar manner, other washing cycles may be performed with suitable temperature values, water level and active wash substance addition. One of the required active wash substances can, for example, be used at a certain temperature of the solution or a particular water level before the temperature or water level is changed and then a further addition of the same or another active substance may take place. The periods which follow can be utilized in a similar manner, for example, to neutralize the remaining alkalinity of the laundry more quickly with the aid of correctly dosed active substances and to add to the laundry a soft rinse agent.

The container 17 for the active wash substances which is schematically schown in FIGS. 2 and 3 is, for example, made of a plastic which is resistant to all the active substances used and is provided with a discharge tube 18 at the side of the container which is pointed toward the metering devices and is located at the lowest spot of the container which itself is horizontally positioned in the machine. This lowest portion of the container is so shaped that the remaining quantity in the emptied container is kept as small as possible. Furthermore, a device is provided in the discharge tube (not shown) which closes the inside space to the outside when the container is removed, so that no active wash substances leak out inadvertently. The discharge tube points toward its respective metering device in such a manner that it is automatically perforated by a hollow thorn, shown in detail in FIG. 4, when the thorn is inserted in the provided mating member which is not shown. A thin closure membrane 20 which closes the discharge tube 18 before insertion of the container is thereby perforated by the hollow slanted thorn 19. The hollow thorn can also serve to open the not shown devices which prevent discharge. A vent tube 21 is located in a position very high up which, in the unused state of the container, is also closed by a membrane. This membrane can also be perforated at the insertion by a hollow thorn as shown, for example, in FIG. 5. In order to avoid having the vent tube 21 form a continuous connection of the container-inner space with the outer air, a simple check valve is provided in the vent thorn (FIG. 5), through which the container can suck in outer air but which prevents a continuous air exchange between the outer and inner air. Otherwise the danger would exist that, after a longer period of use, the contents of the container would dry out, jell or crystallize. The discharge and the vent tubes can be replaced by other suitable arrangements.

In FIG. 6 the containers 17 for the active wash substances, which are arranged adjacent to each other, are shown from the back side. For a clearer understanding the vent thorns (FIG. 5) are not shown so that only the vent tubes 21 are shown. For the same reason the pre-mix channel which is disposed in front of the metering devices is omitted. The metering devices 25 are arranged before the discharge tubes of the containers 17 for the active wash substances. They comprise a pump body 26 with a hollow thorn 19, a discharge tube 27 and a belt pulley 28. A drive belt 29 which engages the belt pulley 28 of all the metering devices is further connected with a similar belt pulley 30 of the common drive motor 31. When this motor is running all belt pulleys 28 are moved. The belt 29 can be a simple flat belt or a toothed belt, whereby the latter is more effective because it permits absolutely no slippage which is of great advantage for exact metering of the active wash substances. Idler rollers 32 are provided for increasing the wrap-around angle at the belt pulley. When using a friction belt the idler rollers may be omitted if the friction belt is alternatingly wrapped around the belt pulleys in the left and right direction.

FIGS. 7 and 8 show a single metering device 35, wherein a gear pump is arranged with gears 33 and 34 disposed in two chambers within the pump body 26. The hollow thorn 19 is connected on the suction side of the gear pump, while the discharge tube 27 is connected on the pressure side, together with the discharge tube of the other metering devices and terminates in the pre-mix channel 12. The gear pump can be driven by a clutch which comprises two wheels 35 and 36, which are in continuous engagement with each other, and the axes 37 and 38 of the same are connected by swingable arms 39 and 40. While the axis 38 is in a fixed, unrotatable connection with the gear 33 and the clutch wheel 36, the wheel 35 can move on its axis in the direction of the rotation. Arms 39 and 40 are in fixed unrotatable connection with this axis but can swing freely on axis 38. The axial spring-loaded pusher 41 of the tongue 42 of a relay acts on the support of wheel 35, the electromagnet of said relay being activated by the program control device at the point in time required for adding the required amount of active wash substance for a time period corresponding to the required dosage. This time which corresponds to the amount to be metered can, for example, be provided by an impulse-length selector for the clutch control which is controlled by a cam of the program-control device. By a suitable design of the impulse-length selector the time can also be made variable. Furthermore, a return spring 44 also acts at the support of wheel 35 which returns arms 39 and 40 again to the rest position, shown in the figure. In the working position which is shown in dotted lines, wheel 35 engages the drive wheel 45 (FIG. 8) which turns with the belt pulley 28. These wheels can be made either as friction wheels or gears. However, for the above-mentioned reason, gears are suitable for this application.

The shown embodiment is described as applied to a front-loading drum-type washing machine. A washing machine according to the invention can also be a top-loading drum-type washing machine. It is also possible to arrange the storage and metering devices below the solution tank in a sufficiently large space, if the other components in this space (drum-motor, wash-solution pump, temperature switch etc.) are condensed in a smaller space. Also, the upper structure for the operating elements of the washing machine can be in some cases utilized to house the containers for the active wash substances. But the upper structure can also contain all control devices. In that case the space corner 46 (FIG. 1) can be utilized for additional containers for active wash substances. A washing machine according to the instant invention can also be realized in any other type of automatic washing machine in which the laundry is moved relative to the wash-solution during the washing process.

Furthermore, the proposed washing machine according to the invention can also be operated with the fresh water admission line not terminating in the water seal, but ending directly in the pre-mix channel. In that case the (additional) water direction means 10 and the ascending line from the same to the pre-mix channel can be omitted. If the washing machine is additionally attached to a warm water line, the possibility of flushing-in the active wash substances by the warm water can be maintained.

When using a water seal 14 as shown in the example of the embodiment, it is advantageous to provide an air venting device (not shown) for the washing solution tank, because otherwise any air compression or depression caused by temperature or liquid amount changes would have to be equalized by the water seal. Instead of the water-directing means 10, an additional circulating pump may be provided in the riser line that leads to the pre-mix channel 12. This additional pump can also be arranged below the solution tank 6. When using a self-priming circulation pump the latter can also be disposed at the entrance of the riser line to the pre-mix channel. In this case it is particularly advantageous if each metering device can be connected by its clutch to the motor provided for the circulation pump. This makes it possible to integrate the metering devices and the circulating pump into one cohesive unit and to operate them in common functional dependence.

In the event a permanently installed container for the active wash substances is used the same arrangement for the containers and the metering devices can be used. However, it is possible to omit the configuration as hollow thorns in the connection between the containers and the metering devices. Rather, fixed connections can be provided in that case. Furthermore, for this purpose filler tubes for each container which can be pulled out may be provided in the upper portion of the machine, which tubes are closed by a cover when not in use.

For just such a case, the upper forward edge of a laundry processing machine, for example, is shown in cross section in FIG. 9. At the front side, the laundry processing machine is provided, for this purpose, with several cutouts 50 which are normally covered or filled out by respective shutters 51. The shutter 51 can be fastened articulatingly to the forward side of the machine housing 1 or, as illustrated, be firmly connected to an extractable or pull-out filling tube or inlet 52 which carries an externally threaded filling nozzle or mouthpiece 53 at the top thereof, as viewed in FIG. 9. A non-illustrated transportable re-supply tank can be screwed onto the filling nozzle 53 by means of a matching pouring outlet or spout. After the active substance has been poured into the filling nozzle 53, the filling tube 52 is pushed back into the inner space of the machine housing 1 so that the shutter 51 is aligned with the front side of the housing 1.

The metering devices 25 which are shown as single units in FIG. 6 can obviously be arranged in one single body. It may also be advantageous here to include the drive motor 31 therein and possibly to couple all clutches either by suitable gearing or by arranging them on a single shaft. The latter feature can be realized when the metering devices are arranged, in contrast to the shown embodiment, not adjacent but behind each other with their side areas pointing toward the containers for the components. The general configuration of the clutches is up to the designer. The example shown in FIGS. 7 and 8 are only chosen to make the explanation simpler.

If in the future, the construction of small motors should prove as smaller or cheaper in comparison to clutches with a common drive motor, then a separate motor without a switchable clutch can be provided for each metering device.

There are claimed:

1. In a washing process for textiles in an automatic washing machine with loading of the textiles in the machine, adding of water, application of active washing substances, structural substances and bleaching agents, agitation of the textiles in the washing solution, pumping off the washing solution, and sequential rinse cycles, the combination therewith of adding the water after loading the textiles in the ratio of 1:4 to 1:30 kg textile to liters water, maintaining said active washing substances in pumpable form, each in a separate container in the washing machine, adding 0.5 to 3.5 g of active washing substances and 2 to 6.5 g of structural substances per liter of washing water, agitating the textiles at a predetermined temperature for a wash period of up to 50 minutes, pumping off the washing solution, and subjecting the textiles to two to five rinse cycles.

2. A washing process according to claim 1, wherein a stabilized bleaching agent, a catalyst which accelerates bleaching and a soft rinse agent are maintained in pumpable form, each in a separate container, for addition to the washing chamber.

3. Process according to claim 1, wherein the washing is carried out in two steps and wherein in the first step of the washing process 0.5 to 1.5 g of active washing substances per 1 washing water is added and from 0 to 3 g structural substances are added per 1 washing mixture, the washing mixture is set for a temperature up to 60° C., the textiles are agitated in the wash solution, the wash solution is pumped off, fresh water is fed in and, in a second step of the washing process, 0.5 to 2 g of active wash substances per liter washing water and 1 to 3.5 g of structural substances per liter wash mixture are added, the wash mixture is set to a temperature of approximately 95° C. and the textiles are continued to be agitated in the washing solution during a wash period of up to 50 minutes.

4. Process according to claim 3, wherein the second step of the washing process is carried out at a temperature of 60° C.

5. Process according to claim 3, wherein during the washing process 0.1 to 0.5 g of a stabilized bleaching agent is added per liter washing solution.

6. Process according to claim 4, wherein during the washing process 0.1 to 0.5 g of a stabilized bleaching agent is added per liter washing solution.

7. Process according to claim 6, wherein a catalyst is added that accelerates the dissociation of the bleaching agent.

8. Process according to claim 1, wherein an organic acid is maintained in pumpable form in a separate container and wherein 0.02 to 0.1 g of said organic acid is added per liter rinse mixture during a rinse cycle.

9. Process according to claim 2, wherein 0.1 to 0.5 g of a soft rinse agent per liter rinse water are added during a rinse cycle.

10. Process according to claim 1, wherein a combination of the following active substances in pumpable form are placed in the washing machine:

1. active washing substances,
2. structural substances,
3. a stabilized bleaching agent,
4. a catalyst which accelerates the bleaching process,
5. an organic acid,
6. a soft rinse agent, and wherein the respective active substances are in small separate containers adapted to be installed in the machine and suitable for use in the household.

11. Process according to claim 10, wherein the active substances are present in the following quantitative relationship:

0.5–3.5 parts per weight of active washing substance,
2.0–6.5 parts per weight of structural substances,
0.1–0.5 parts per weight of stabilized bleaching agent,
a catalyst which accelerates the bleaching process in an at least stoichiometric amount respective to the bleaching agent,
0.02–0.1 parts per weight of an organic acid, and
0.1–0.5 parts per weight of a soft rinse agent.

12. Process according to claim 10, wherein the active wash substance has the following compositon:

20–25 weight percent of sodium salt of a straight chain alkyl ($C_{10}$–$C_{13}$) benzene-sulfonate
1.2–1.8 weight percent of sodium salt of toluolsulfonate
8.0–9.5 weight percent of sodium salt of hardened tallow fatty acid-soap
12.5–16.5 weight percent of the reaction product of tallow fatty alcohol with 11 moles ethylene oxide
9.5–13.0 weight percent isopropanol
0.3–0.5 weight percent NaOH
and 100.0 weight percent water of 0°–14° dH.

13. Process according to claim 10 wherein the active wash substance has the following composition:

13.0–17.0 weight percent of sodium salt of olefinsulfonate containing 16–18 carbon atoms
30.0–35.0 weight percent of the reaction product of oleylalcohol and 10 moles ethylene oxide and 3 moles propylene oxide
2.0–4.0 weight percent of the sodium salt of hardened tallow fatty acid-soap
9.0–11.0 weight percent isopropanol
and 100.0 weight percent water of from 0°–14° dH.

14. Process according to claim 10, wherein the structural substance has the following composition:

35.0–40.00 weight percent tri potassium polyphosphate
0.8–1.8 weight percent sodium silicate (water glass)
0.5–0.9 weight percent NaOH
and 100.0 weight percent water of from 0°–14° dH.

15. Process according to claim 10, wherein the structural substance has the following composition:

44.0–47.0 weight percent Na-nitrilotriacetate
0.8–1.6 weight percent sodium silicate (water glass)
1.0–2.0 weight percent NaOH
and 100.0 weight percent water of from 0°–14° dH.

16. Process according to claim 10, wherein the bleaching agent has the following composition:

5.0–10.0 weight percent $H_2O_2$
0.1–0.15 weight percent dipicolinicacid
and 100.0 weight percent water of from 0°–14° dH.

17. Process according to claim 10, wherein N-acetylcaprolactam is the catalyst to accelerate the bleaching process.

18. Process according to claim 10, wherein the organic acid component has the following composition:

2.0 weight percent citric acid
0.2 weight percent lactic acid
0.2 weight percent acetic acid
and 100.0 weight percent water of from 0°–14° dH.

19. Process according to claim 1, wherein the amount of structural substances added will vary with the degree of hardness of the washing water with increasing amounts used for water of greater hardness to compensate for the increased hardness.

20. Process according to claim 1, wherein for washing slightly soiled textiles the active washing substances added are 0.5 to 1.5 g and the structural substances added are 2 to 3.5 g per liter of washing water; for washing average soiled textiles the active washing substances added are 1 to 2.5 g and the structural substances added are 3 to 4.5 g per liter of washing water; and for very soiled textiles the active washing substances added are 2 to 3.5 g and the structural substances are 4 to 6.5 g per liter of washing water.

21. Process according to claim 1, wherein for washing of heavy white textiles the water added after loading the textiles is in the ratio 1:4 to 1:5 kg textile to liters water; for more delicate textiles the ratio is 1:10 to 1:22; and for wool the ratio is 1:20 to 1:30.

22. Process as claimed in claim 1, wherein the structural substances are complex alkali phosphates, and in areas of soft water of from 0° to 7° dH adding complex alkali phosphates to active washing substances in the weight ratio of 1:1 to 1.5:1; in areas of medium water hardness of 7° to 14° dH adding phosphates to active washing substances in the ratio of 1:1 to 2.5:1; and in areas of hard water of 14° dH and above adding complex alkali phosphates to active washing substances in the ratio of 2:1 to 3:1.

* * * * *